United States Patent [19]

Genco et al.

[11] Patent Number: 4,540,468

[45] Date of Patent: Sep. 10, 1985

[54] METHOD FOR DETERMINING THE DEGREE OF COMPLETION AND PULP YIELD

[75] Inventors: Joseph M. Genco; John C. Hassler, both of Orono, Me.

[73] Assignee: Board of Trustees of the University of Maine, Bangor, Me.

[21] Appl. No.: 535,922

[22] Filed: Sep. 26, 1983

[51] Int. Cl.[3] ..... D21C 7/12

[52] U.S. Cl. ..... 162/49; 162/61; 436/146

[58] Field of Search ..... 162/49, 238, 263, DIG. 10, 162/61, 62; 436/146

[56] References Cited

U.S. PATENT DOCUMENTS

| | | | |
|---|---|---|---|
| 3,672,841 | 6/1972 | Freeman, Jr. et al. | 436/146 |
| 3,674,434 | 7/1972 | Pottenger | 162/49 |
| 3,854,877 | 12/1974 | Csaky et al. | 436/146 |

FOREIGN PATENT DOCUMENTS

| | | | |
|---|---|---|---|
| 0580265 | 11/1977 | U.S.S.R. | 162/49 |
| 0702087 | 12/1979 | U.S.S.R. | 162/238 |

OTHER PUBLICATIONS

Bublitz, "Fluorescence of Pulping Liquors: A Tool For Digester Control?", *TAPPI,* Jun. 1981, vol. 64, No. 6, p. 73.

McDonald, "Calorific Value of Spent Liquors by Carbon Analysis", *TAPPI,* Dec. 1977, vol. 60, No. 12, p. 107.

*Primary Examiner*—Steve Alvo

*Attorney, Agent, or Firm*—Daniel H. Kane, Jr.

[57] ABSTRACT

A method is described for monitoring and determining the degree of completion, pulp yield, and residual lignin content in a pulping or delignification reaction. The system provides an on-line, real time, closed loop process control system for the reaction of a known quantity of wood in process liquor. The desired pulp yield is achieved by sampling the liquor during the reaction; determining the total organic carbon content of the sampled liquor; and calculating the degree of completion of the reaction and pulp yield from the process liquor total organic carbon content determination using an appropriate mathematical model. The mathematical model is based upon conservation of carbon mass in the wood or pulp and liquor during the reaction, and includes a conservation of mass equation in which the total organic carbon in the sampled liquor substantially equals the total carbon in the starting quantity of wood or pulp less the total carbon in pulp wood residue at the time of sampling the liquor. Variations of the basic system and method are described.

19 Claims, 8 Drawing Figures

METHOD FOR DETERMINING THE DEGREE OF COMPLETION AND PULP YIELD

TECHNICAL FIELD

This invention relates to a new method for monitoring and determining the degree of completion, pulp yield, and residual lignin content in a pulping or delignification reaction. The invention provides an on-line, real time, closed loop process control system for achieving the desired pulp yield in the reaction of a known quantity of wood digesting in liquor. The invention is applicable to a variety of chemical and semi-chemical delignification processes whether conducted in a batch or continuous process and to both primary bulk delignification or pulping, and secondary delignification also referred to as bleaching.

BACKGROUND ART

The sequence of operations in the manufacture of chemical wood pulp includes debarking and chipping of the wood, pulping or bulk delignification of the chipped or fragmented wood, secondary delignification or bleaching, and subsequent pulp washing, screening and cleaning steps. The present invention is specifically directed to the pulping reaction and delignification steps in which the lignin polymers are separated from the cellulose fibers. Although pulping is fundamental to the manufacture of paper, the pulping reaction itself is not fully understood. Chemical pulping processes are conducted under both (Sulfite Process) and basic (Kraft Process) conditions. The Kraft Process is the dominant technology practiced industrially, accounting for approximately three-fourths of the total pulp production. Kraft Process chemical delignification is conducted by both batch and continuous methods.

The control of such a pulping operation is generally accomplished by means of an open loop, feed forward system. The most common system uses the "H-factor" method. According to the H-factor method, if the initial charge conditions such as chip moisture content, sulfidity, liquor to wood ratio, pH range, and percent active alkali by weight are fixed, then cooking to a given H-factor will result in the same identified pulp yield and lignin content or Kappa number. The time-temperature history of the cook is monitored. The "relative" rate of reaction data for the applicable times and temperatures as set forth by K. E. Vroom, *Pulp Paper Mag. Can.,* Vol 58(3), Page 228 (1957) are generally applicable. Therefore, the relative reaction rate data is integrated over time to predict the degree of delignification associated with the H-factor. The "cook" is then stopped at an H-factor which is known to give the acceptable identified pulp yield. The H-factor method is therefore used to predict when to stop the digestion or "cook" in order to achieve a desired pulp yield. Upon stopping the reaction the pulp must then be analyzed for lignin content to ascertain whether the desired degree of completion has in fact been achieved. These results are used to adjust the cooking parameters to be used on subsequent "cooks".

A disadvantage of the conventional method is that the control of the pulping operation end result is strongly dependent upon the maintenance of uniform conditions of chip moisture content, temperature, chemical feed properties, etc. It has not been possible to measure certain of these variables such as chip moisture content in any practical way. As a result the outcome of one reaction is used to correct the conditions for the next in a trial and error procedure on the assumption that the average chip properties will remain reasonably uniform. Overall, it has not been possible to date to close the open control loop of the H-factor method because of the lack of suitable process measurements.

Another approach to controlling the quality or degree of the pulp delignification is by measuring the "Kappa number". The Kappa number is defined by TAPPI standard T-236, "Kappa Number of Pulp", Technical Association of the Pulp and Paper Industry, Atlanta, Ga. The Kappa number is directly related to the Klason lignin content of the pulp according to a relationship that the percent lignin in the pulp equals 0.147 times the Kappa number. This relationship is described by Casey, *Pulp and Paper Chemistry and Chemical Technology,* Wiley Interscience, N.Y. (1980) (p. 665). The Kappa number, however, is not suitable for on-line measurement because the pulping reaction must be terminated in order to measure the Kappa number of the residual wood or pulp. Models have been developed for inferring the Kappa number from measurement of other parameters, such as for example, the measurement of sulfidity of the liquor by a selective ion electrode, the conductometric titration of a liquor sample by acid and by optical and calorimetric methods. None of these, however, has been widely accepted by the industry, and virtually all pulping control in the United States is done by means of the H-factor method or equivalent feed forward control. Furthermore, there is no generally accepted procedure for on-line monitoring and control of pulp yield in secondary delignification or bleaching reactions.

U.S. Pat. No. 3,674,434 describes a "method and apparatus for determining lignin content" by direct measurement of a sample "based upon a discovered linear relationship between the lignin content of wood or residual wood pulp and the ratio of elemental carbon to elemental hydrogen in the sample". This method requires that the reaction be terminated for direct sampling of the wood pulp. The sample is dried to a standardized moisture content and then analyzed to determine the ratio of carbon to hydrogen. The lignin content is then computed using an equation which relates percent lignin to the ratio of elemental carbon to elemental hydrogen. This method is unsuited for on-line real time monitoring and process control.

U.S. Pat. No. 4,193,840 describes a method for determining the degree of delignification by monitoring a combination of temperature and pressure. U.S. Pat. No. 4,162,933 seeks to ascertain the degree of delignification by monitoring exothermic heat. Because the measured parameters are only indirectly related to the desired information, the required reliability for on-line process control cannot be achieved.

The Institute of Paper Chemistry (IPC) is currently sponsoring a program for determination of pulp yields in continuous digesters. The technique under investigation by IPC contemplates using the carbohydrate fraction of the pulp as a prediction of yield in continuous digesters. The IPC method depends on the assumption that the yield of cellulose as a percentage of a particular wood species is essentially constant during a Kraft reaction. The IPC method contemplates that accurate determination of pulp carbohydrates by gas chromotography will lead to a prediction of pulp yield. The IPC method, however, is not applicable to on-line real time measurement of pulp yield.

OBJECTS OF THE INVENTION

It is therefore an object of the present invention to provide a method for on-line real time monitoring and determination of degree of delignification and pulp yield for closed looped process control of delignification and pulping reactions including both primary delignification or pulping, and secondary dilignification or bleaching reactions. It is also intended to provide determination of the heat content of the process liquor.

Another object of the invention is to provide an on-line real time process control for chemical pulping and bleaching which optimizes the yield of a uniform quality product with a desired degree of delignification while minimizing the use of energy, chemicals, and wood. Further, the invention seeks to achieve more efficient operation of equipment in existing pulping and bleaching operations by minimizing the trial and error required to determine the operating conditions for different grades of raw materials or desired end products.

Yet another object of the invention is to afford significant savings in capital through increased productivity by increasing the throughput capacity of existing pulp digesters. The pulp and paper industry is very large, having sales in the order of twenty billion dollars per year. Even small changes in efficiency therefore afford a large dollar value saving. The economic benefits achieved through improved control of the pulping operation according to the present invention are therefore significant.

DISCLOSURE OF THE INVENTION

In order to accomplish these results, the present invention provides an improved method for monitoring and determining the degree of completion and pulp yield of a pulping or delignification reaction for a known quantity of wood of identified characteristics immersed and digesting or reacting in a process liquor at a known liquor to wood ratio. The invention contemplates sampling the liquor during the pulping or process reaction; determining the total organic carbon content of the sampled liquor; and calculating the degree of completion of the process reaction and pulp yield from the liquor total organic carbon content determination using an appropriate mathematical model. The mathematical model is based upon conservation of carbon mass in the wood and liquor during the reaction, and includes a conservation of mass equation in which the total organic carbon in the sampled liquor substantially equals the total carbon in the starting quantity of wood or pulp less the total carbon in the pulp wood residue at the time of sampling the liquor.

The invention closes the loop of process control on-line in real time by controlling the reaction according to the calculated degree of completion and pulp yield. Such control is achieved, for example, by controlling the duration, temperature or liquor to wood ratio of the pulping or delignification reaction. The invention contemplates as a final step terminating the reaction at the desired degree of completion and pulp yield predicted by the mathematical model in accordance with the process liquor total organic carbon content determination. A feature and advantage of the invention is that it is applicable both to primary delignification or pulping in black liquors, and to secondary delignification in caustic bleaching liquors.

According to one embodiment of the invention, the step of determining the total organic carbon content of the sampled liquor is carried out by determining the total carbon content of the liquor sample, determining the total inorganic carbon content of the sampled liquor and subtracting the inorganic carbon content from the total carbon content to give the total organic carbon content. A feature and advantage of the method is that the total organic carbon (TOC) provides a consistent measure of the degree of delignification over a wide range of pulp yields.

According to another aspect of the invention, the Kappa number may be inferred from the pulp yield calculated from the total organic carbon determination by the mathematical model. The Kappa number may be inferred and specifically calculated using the established direct linear correlation between the yield of the pulping reaction and the Kappa number of the resulting pulp. Thus, for the Kappa number in the range of 30 to 90, the pulp yield from softwood generally increases in a linear fashion about 1.4% for every ten unit increase in Kappa number as described by Kleppe, *TAPPI,* 53 (1) p. 35 (1970).

While it is not possible to do a complete elemental analysis of black liquor or bleaching liquor in a time frame practical for process control, according to the present invention it is possible to measure total organic carbon (TOC) or to measure total carbon (TC) and total inorganic carbon (TIC) and obtain the TOC by difference. In one example embodiment the total carbon (TC) is measured by total combustion of the sampled liquor and measuring the amount of $CO_2$. Similarly, total inorganic carbon (TIC) is measured by determining the $CO_2$ produced by low temperature acidification of a similar sample. The quantity of $CO_2$ generated may be measured by gravimetric methods or preferably using infrared spectrophotometry. A microprocessor may be used to compute the TOC from the TC and TIC measurements. Furthermore, the mathematical model according to the present invention is programmed into the microprocessor to estimate the yield, Kappa number and heat content of the liquor. From the estimated yield, adjustments are made in the heating schedule of the "cook", either the time of duration of the "cook", or the temperature at which the "cook" is conducted. In batch operations, the time is generally adjusted. In continuous operations, the temperature is generally adjusted.

A feature and advantage of the method of the present invention is that the step of calculating the total inorganic carbon in the liquor may be omitted since the inorganic carbonate ($CO_4^{=}$) acts as a dead load on the system merely shifting the baseline of the total carbon measurement. Thus, in most instances accurate determination of degree of completion of delignification and pulp yield may be accomplished by applying the mathematical model to measurement of total carbon.

The total carbon or total organic carbon may also be determined by measuring and determining the quantity or concentration of radioactive carbon isotopes present in the liquor sample and inferring the total carbon or total organic carbon from the measured fractional radioactive carbon isotopes.

The mathematical model for calculating degree of completion and pulp yield is based upon conservation of carbon mass in the pulp wood and liquor and generally uses a conservation of mass equation in which the total organic carbon measured in the sampled liquor substantially equals the total carbon in the starting quantity of wood or pulp less the total carbon in the pulp wood residue at the time of sampling. The total carbon content of the starting wood equals the total carbon content of the wood carbohydrates including cellulose and hemicellulose products, wood lignin and wood extractives. Correction may be necessary for any carbon content of the starting liquor. This is accomplished by determining the TOC content of the starting liquor, determining the TOC content of the sampled liquor, and subtracting the TOC content of the starting liquor from the TOC content of the sampled liquor. This technique thereby provides the TOC of the liquor attributable to digestion of the starting quantity of wood or pulp during the pulping or delignification reaction.

A further feature and advantage of the invention is that the total organic carbon determination particularly for black liquor and the mathematical model permit monitoring the heat value or heat content of black liquor on-line in real time.

Other objects, features and advantages of the invention are set forth in the following specification and accompanying drawings.

DESCRIPTION OF PREFERRED EXAMPLE EMBODIMENTS AND BEST MODE OF THE INVENTION

Figure 1:
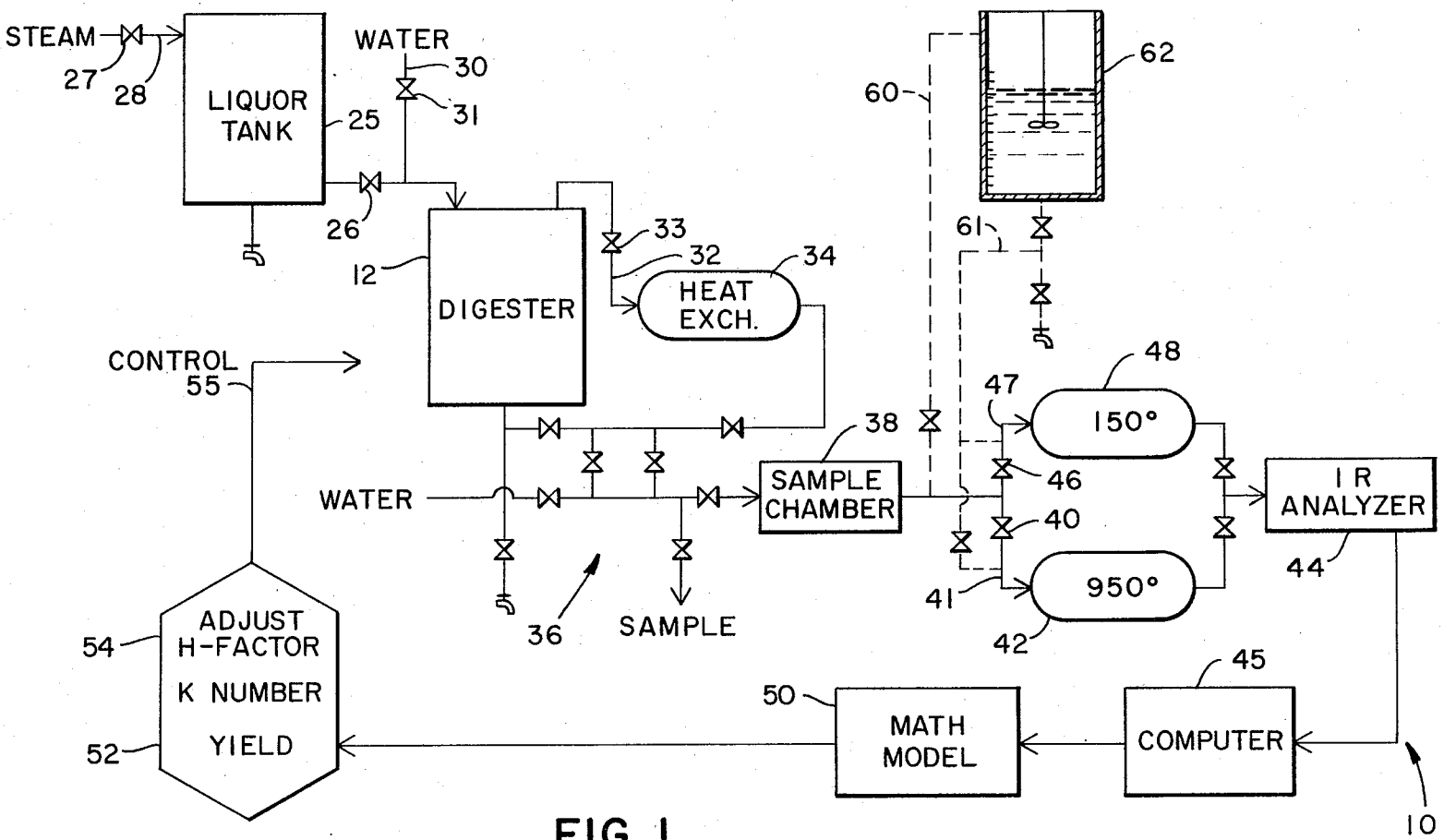
FIG. 1 is a block diagram of an on-line real time closed loop process control system for a Kraft batch pulping operation or delignification reaction according to the invention.

An on-line, real time, closed loop control system 10 for process control of the degree of completion and yield of batch Kraft pulping or delignification is illustrated in FIG. 1. Kraft pulping conditions are established in the digester 12 of system 10 according to Kraft pulping procedures, for example as described by Sjostrom, *Wood Chemistry Fundamentals and Applications,* Academic Press, N.Y. (1981) (pp. 124–145). Typical Kraft pulping conditions prevailing in digester 12 are summarized in Table 1.

TABLE 1

TYPICAL KRAFT PULPING CONDITIONS

| Item | Value |
|---|---|
| pH Range | 13–14 |
| Base | $Na^+$ |
| Active Agent | $HS^-$, $OH^-$ |
| Max. Temp. (°C.) | 155–175 |
| Time to Temp. (hr.) | ½ to 1 |
| Time at Temp. | 1–3 |
| Sulfidity % | 20–30 |
| Active Alkali, % $Na_2O$ on Wood | 16–24% |
| Liquor to Wood Ratio | 3.5–5 |
| Softwood Pulp Yield, % | 45–55 |

Figure 1A:
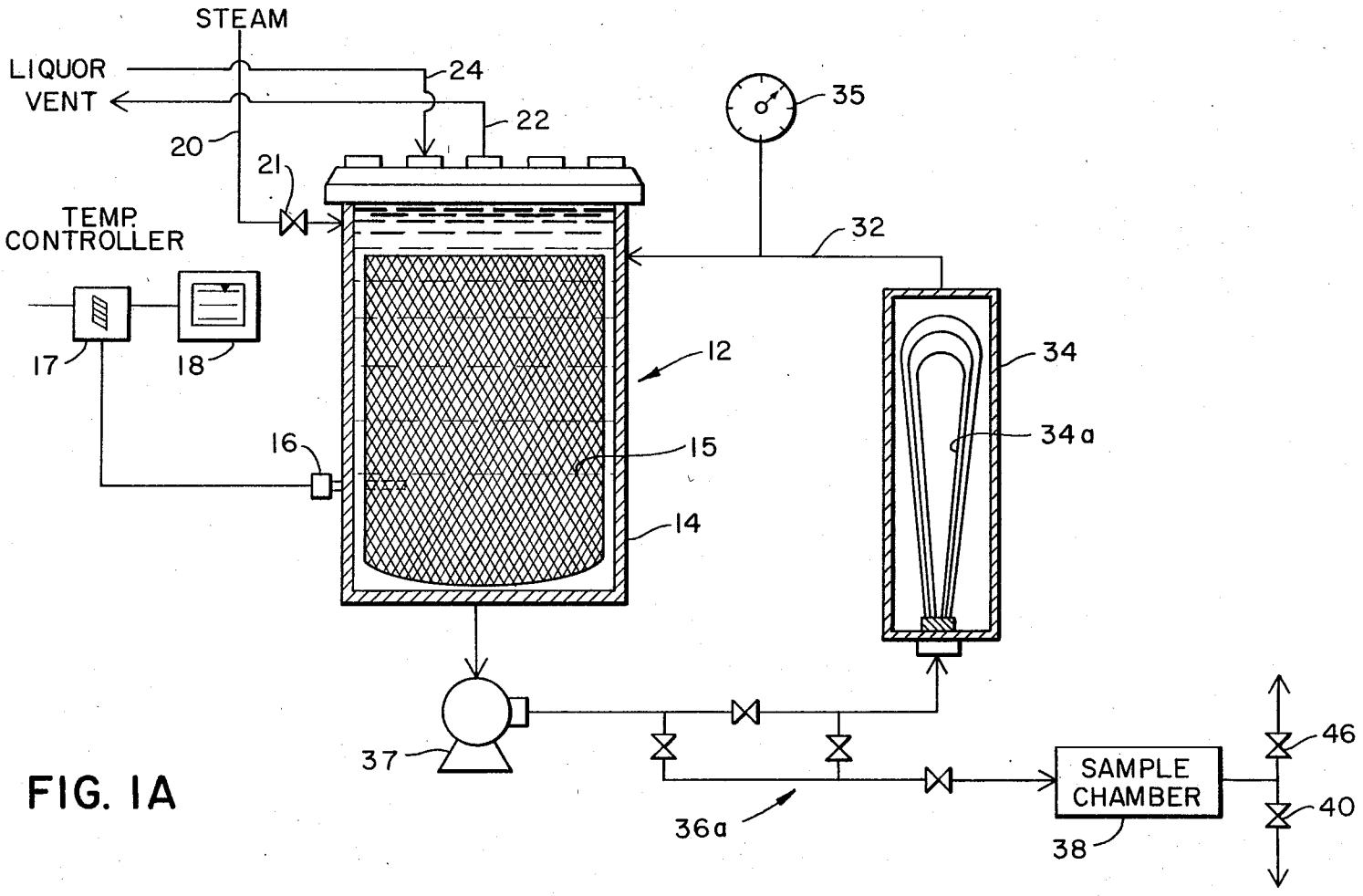
FIG. 1A is a detailed diagrammatic view of the pulp digester.

Details of the experimental digester for demonstrating the utility of the present invention are shown in FIG. 1A. The digester 12 includes a stainless steel pressure container 14 in which is suspended a basket or cage 15 for containing the wood chips. A thermocouple 16 is mounted on the side of the digester connected to an appropriate detector 17 and readout 18 for indicating the temperature of liquor in the digester. Steam line 20 delivers steam into the digester 12 through control valve 21 for controlling the temperature in the digester and thereby the pulping rate. The digester also includes vent line 22 and a liquor supply line 24 through which white liquor may be supplied from the liquor storage tank 25 under control of the control valve 26. Adjustment of the liquor to wood ratio affords another parameter for controlling the pulping rate. The temperature of liquor in storage tank 25 may also be controlled by admitting steam through control valve 27 on line 28.

The white liquor stored in liquor storage tank 25 is typically a mixture of constituent chemicals sodium hydroxide (NaOH) and sodium sufide ($Na_2S$) which may be diluted to a desired concentration by water on line 30 controlled by valve 31. For the experimental examples hereafter described, distilled water may be used to avoid introduction of carbonate contaminants.

The digester 12 also includes a heat exchange feedback loop 32 through heat exchanger 34 as an alternative arrangement for controlling the temperature of the liquor in digester 12. An electrical heating element **34*a* may be included in the heat exchanger. Pressure gauge 35 provides a measure of the pressure in the system applied to wood chips contained in the basket or cage 15 of digester 12**.

In the operating system of FIG. 1 any of a number of line and valve configurations 36 may be provided for sampling black liquor from digester 12 during the reaction and for controlling the delivery of such samples to sample chamber 38. An alternative line and valve configuration **36*a* including pump 37 is illustrated in FIG. 1A**.

Such a sample contains carbon compounds from the constituent components of the wood, namely the carbohydrate components including cellulose and hemicellulose, the lignin component, and the extractive components including the resins, phenols and terpenes. In addition, carbon may also be present from inorganic carbonates contained in the original white liquor or dead load organic carbon in any recycled black liquor initially or subsequently added. According to the invention the total carbon content and in particular the total organic carbon content of the sample of black liquor delivered to sample chamber 38 is used to ascertain the degree of completion, pulping rate, and yield of the pulping reaction in digester 12.

As shown in FIG. 1, the black liquor sample in sample chamber 38 is divided into two portions. One portion is delivered through control valve 40 on line 41 to combustion tube 42 which combusts the first portion of the black liquor sample at 950° C. to 1,000° C. for complete combustion of the sample in order to obtain a determination of the total carbon content of the first sample portion. Substantially all carbon is transformed to $CO_2$ in combustion tube 42 and the $CO_2$ content is ascertained by infrared spectrometry in infrared (IR) analyzer 44. Appropriate adjustment and compensation is made for the presence of any interfering water vapor. The total carbon determination signal based upon the $CO_2$ determination is fed to computer microprocessor 45.

The second portion of black liquor sample from sample chamber 38 passes through control valve 46 on line 47 to reaction tube 48. The inorganic carbon contained in the second sample portion, generally in the form of carbonates, is released by acidifying the sample and heating at relatively low temperature, for example 150° C., thereby reacting and releasing the inorganic carbon in the form of $CO_2$. The total inorganic carbon is similarly measured by infrared spectrometry measuring the released $CO_2$ in IR analyzer 44. The total inorganic carbon signal is input to computer 45. The total organic carbon content of the sample is determined by subtracting the total inorganic carbon from the total carbon determinations and the TOC data is applied to the conservation of carbon mass mathematical model 50 hereafter described, programmed into the computer microprocessor 45.

The mathematical model 50 calculates the Kappa number and yield of pulp in digester 12 as a linear function of total organic carbon. The calculated Kappa number and yield data 52 is compared with the desired Kappa number and yield to be achieved by the digestion reaction or "cook" and the system responds by recalculating and adjusting the H-factor data 54 which gives the time to desired degree of completion of the reaction.

Alternatively, the calculated Kappa number and yield data 52 may be used to control and vary the pulping reaction rate by controlling the temperature of the black liquor in digester 12 or the ratio of black liquor to wood through appropriate control apparatus not shown on line 55. Thus, in order to control the temperature of black liquor in digester 12, appropriate control apparatus is provided to regulate steam valve 21 of FIG. 1A, steam valve 27 of FIG. 1, or valves such as valve 33 in the heat exchange control loop 32 of FIG. 1. Control of the liquor to wood ratio may be accomplished through appropriate control apparatus coupled to liquor control valve 26 and diluent control valve 31 of FIG. 1. If the H-factor and therefore time to completion is adjusted, the reaction in digester 12 is terminated at the end time by withdrawing the basket or cage 15 and pulpwood chips from the reactor or digester 12.

To demonstrate the utility of the present invention a number of experimental examples were carried out using, for example, in each instance, a thousand grams of chipped softwood such as red spruce, in the basket 15 of digester 12. The enclosure 14 forms a pressurized container and the wood chips may be soaked in water and steamed, then weighed to ascertain initial moisture content. White liquor is then added to the digester immersing the wood chips in a liquor to wood ratio of for example, 11:1, greater than the typical industry ratio in the range of for example, 3.5:5.1. In other respects characteristic Kraft conditions are maintained. Recycled black liquor may also be added to the digester. The active alkalinity and sulfidity of the liquor are initially determined according to the TAPPI procedures and standard T-624. The constituent composition of the wood is also known or ascertained, which for red spruce is generally characterized by carbohydrate (cellulose and hemicellulose) content of 69.8%, lignin 25.3%, and extractives 4.9%. Except as set forth above, each of the cooks or reactions were run generally under the same conditions set forth in Table 1 and for varying lengths of time to achieve different yields. Pressure in the digester was generally maintained at approximately 102 psig.

Figure 2:
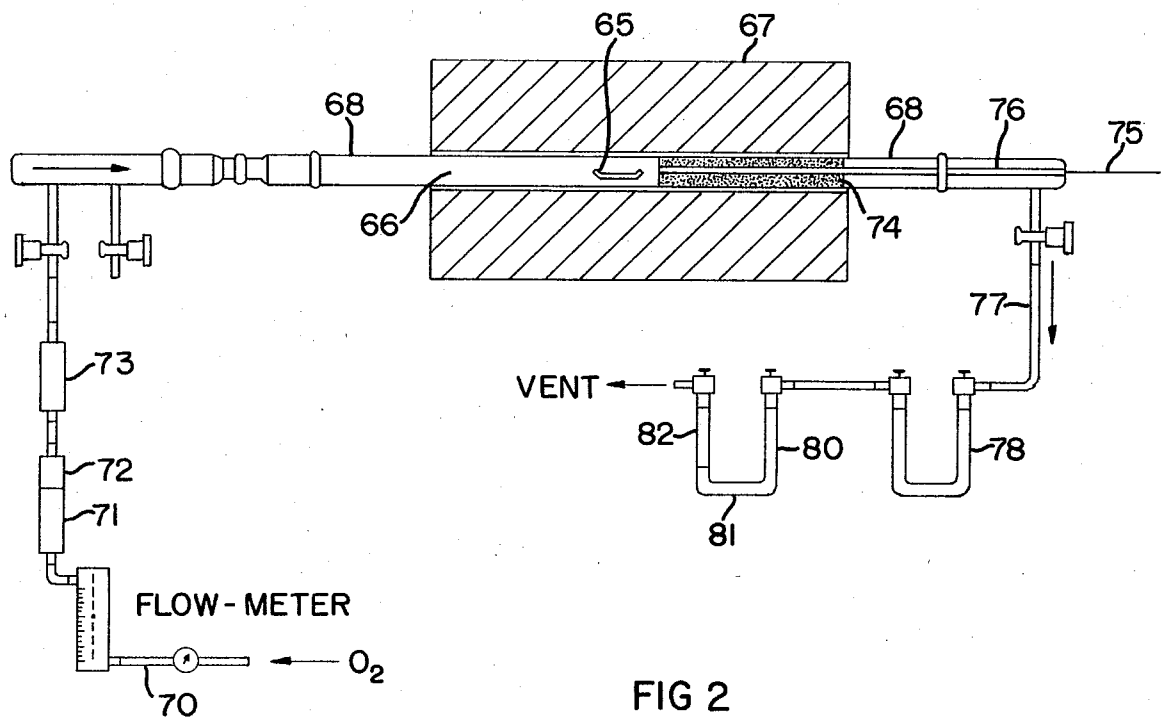
FIG. 2 is a schematic diagram of apparatus for combustion of sampled black liquor and for gravimetric analysis of $CO_2$ and $H_2O$.

Black liquor samples were taken through diversion lines indicated by dotted lines 60 and 61 of FIG. 1 to a separate sample bottle 62 for determination in the separate measuring apparatus illustrated in FIG. 2. The black liquor sample in sample bottle 62 was first diluted and mixed to a desired dilution using distilled water. The starting white liquor was carefully prepared essentially to avoid the presence of inorganic carbon which would generally be in the form of carbonates in the starting liquor. A single total carbon determination alone was therefore made using the apparatus of FIG. 2 essentially equivalent to the total organic carbon content of the black liquor sample. Black liquor samples were taken, for example, at twenty minute intervals during the cooking or reaction time lasting, for example, from 74 minutes to 220 minutes at the desired temperature of, for example, 155° C. to 175° C.

Referring to FIG. 2, each sample was placed in a sample boat 65 and inserted into the chamber 66 of a combustion furnace 67 formed around combustion tube 68. The temperature in furnace 67 was in the range of 900° C. to 1,000° C. and oxygen was directed to pass or flow over the sample boat 65. As shown in FIG. 2, oxygen is delivered on line 70 and any $CO_2$ contamination in the $O_2$ gas is absorbed onto an Ascarite (trademark) filter 71 and manganese perchlorite, $Mg(CLO_4)_2$, filter 72. Any water or water vapor in the gas is absorbed after passing through the Dryerite (trademark) filter 73. Oxygen flowing over the sample boat 65 in furnace 67 forming $CO_2$ passes through a copper oxide (CuO) catalytic combination bed 74 to insure complete combustion. Thermocouple wire 75 passing through the annular insert 76 in reaction or combustion tube 68 permits monitoring the temperature of furnace 67 and reaction chamber 66.

The combustion end product gases from combustion of the carbon in the sample portion contained in the sample boat 65 passes through the outlet line 77 from the combustion tube 68 into gravimetric determination tubes 78 and 80. Tube 78 contains Dryerite (trademark) for absorption and removal of water vapor from the combustion end product gases. The combustion gases then pass through gravimetric determination tube 80 containing Ascarite (trademark) 81 and manganese perchlorite 82 for substantially complete removal and absorption of any $CO_2$ gas. The mass of $CO_2$ removed from sample boat 65 by combustion in reaction tube 80 is then determined gravimetrically. The water or water vapor may be similarly determined gravimetrically using tube 78.

In the experimental procedures above the total carbon determination for the sampled black liquor measured gravimetrically is essentially equivalent to the total organic carbon content of the sampled black liquor. Where measurable amounts of inorganic carbon are present in the black liquor sample, inorganic carbon may be measured by acidifying a similar sample and heating at relatively low temperature followed by gravimetric determination of $CO_2$ in the manner illustrated in FIG. 2. The total organic carbon would then be obtained by the difference between the total carbon determination and the total inorganic carbon. It may also be necessary to take into account and compensate for "dead load" organic carbon in any recycled black liquor used in the starting liquor. In that event, a sample of the starting liquor would be combusted for a similar $CO_2$ determination attributable to dead load carbon.

While the apparatus of FIG. 2 provides accurate determination for experimental demonstration of utility, it would not be suitable for continuous routine use in the industrial conditions of a pulp and paper mill. For routine industrial use the apparatus of FIG. 1 would be used with infrared spectrophotometric rather than gravimetric analysis. Alternatively, another method for determining total carbon and total organic carbon is scintillation counting of the radioactive isotopes of naturally occurring organic carbon. Thus, detection of carbon 13 (C13) and carbon 14 (C14) provides reliable basis for inference of total organic carbon present according to relative standard isotopic abundance.

A non-dispersive spectrophometric IR analyzer device is used with dual infrared wave lengths or dual channels for measurement. This permits the analysis of $CO_2$ in the presence of water. The combustion gases pass through a flow through IR analyzer sample cell, and the infrared absorption is integrated over time. The relative sizes of the peaks at different wave lengths are used to remove the interference due to water. For example, a Perkin Elmer Model (trademark) type spectrophotometer may provide signals to the microprocessor 45 to perform the integration of the peaks and the calculations in real time. For complete automation of the delignification or pulping reaction process control, automatic sampling apparatus for sampling the black liquor is also provided.

Figure 3:
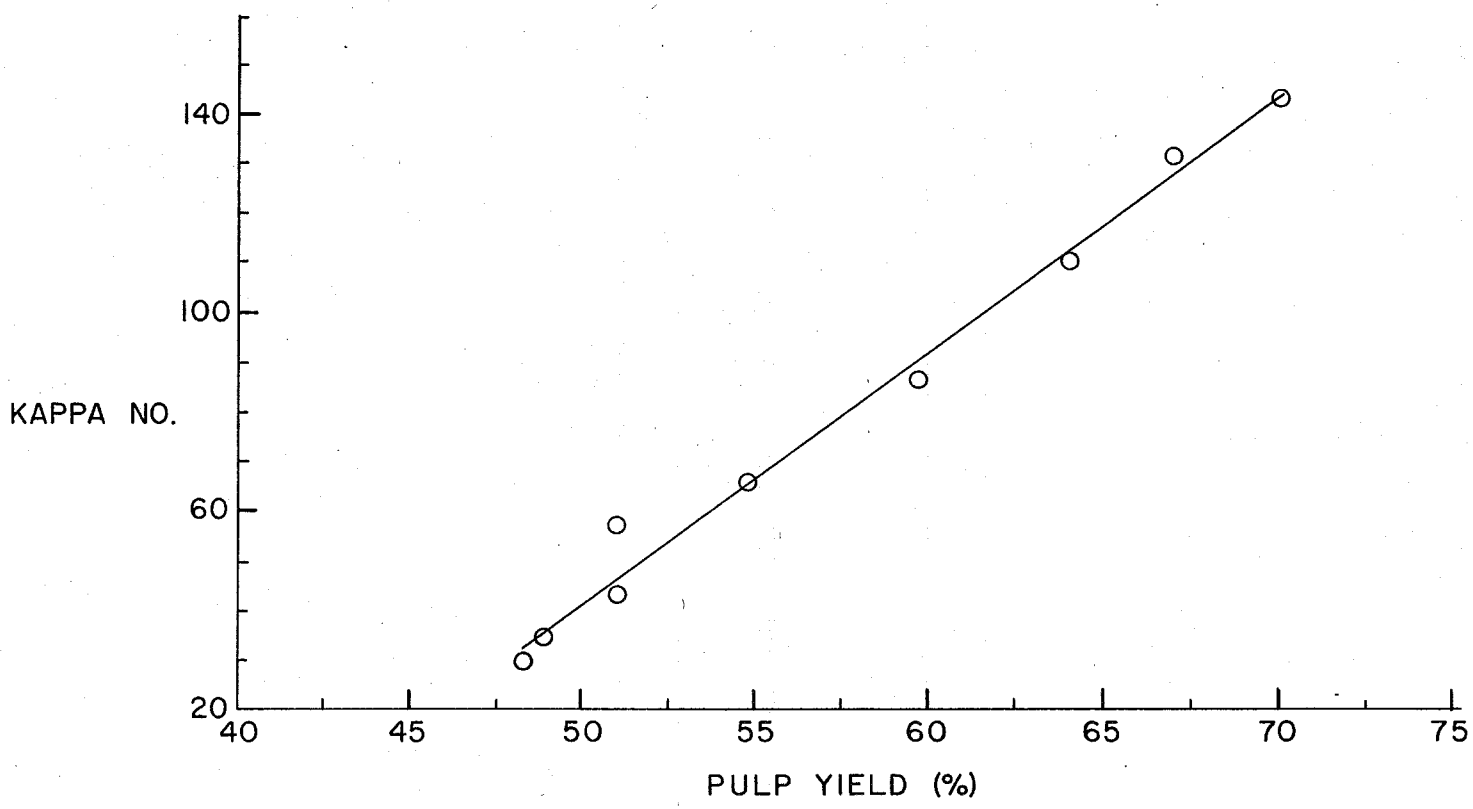
FIG. 3 is a graph of pulp yield versus Kappa number showing the empirically established direct linear relationship between pulp yield and Kappa number of the pulp.
Figure 4:
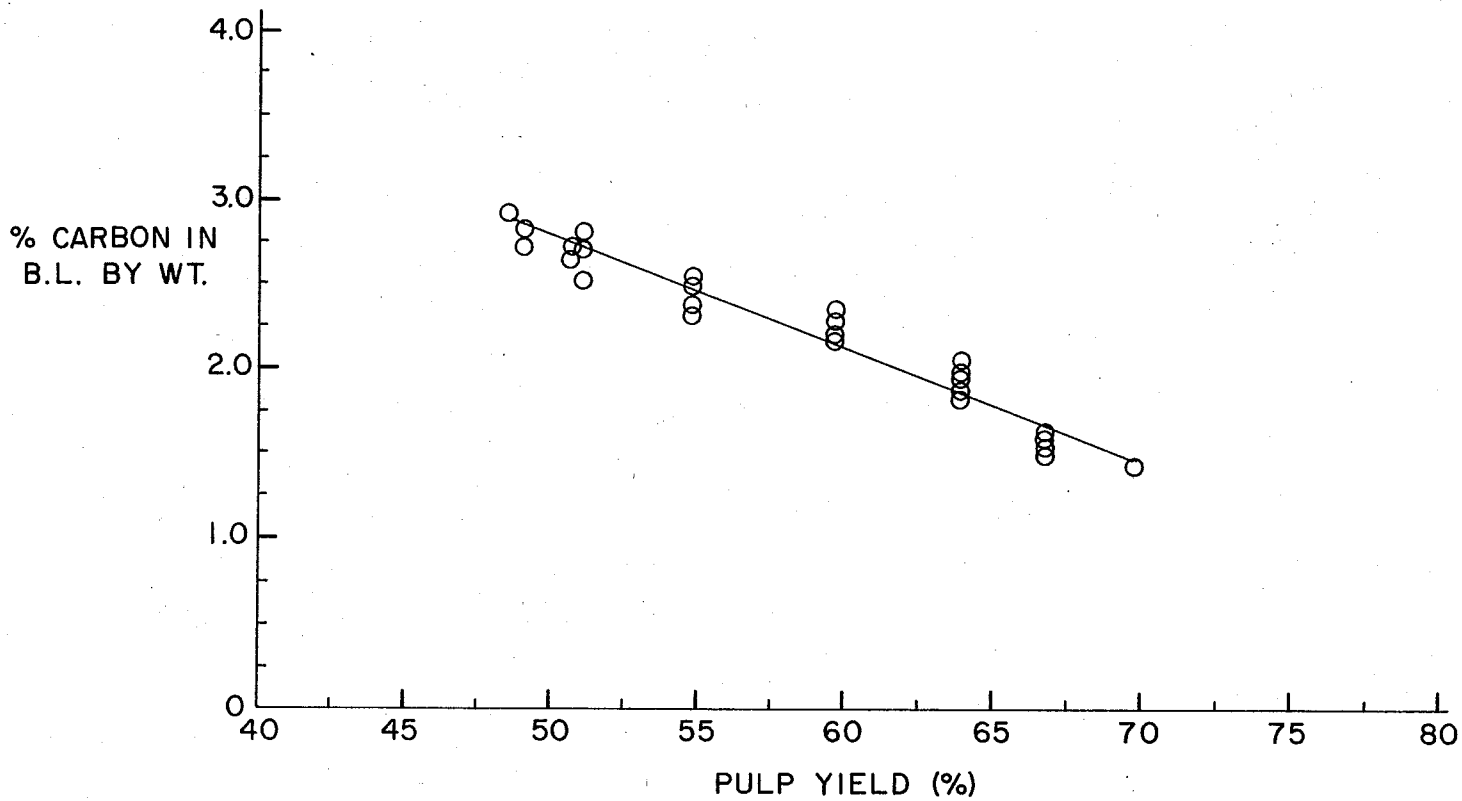
FIG. 4 is a graph of pulp yield versus black liquor total organic carbon showing the inverse linear relationship established by empirical measurement.
Figure 5:
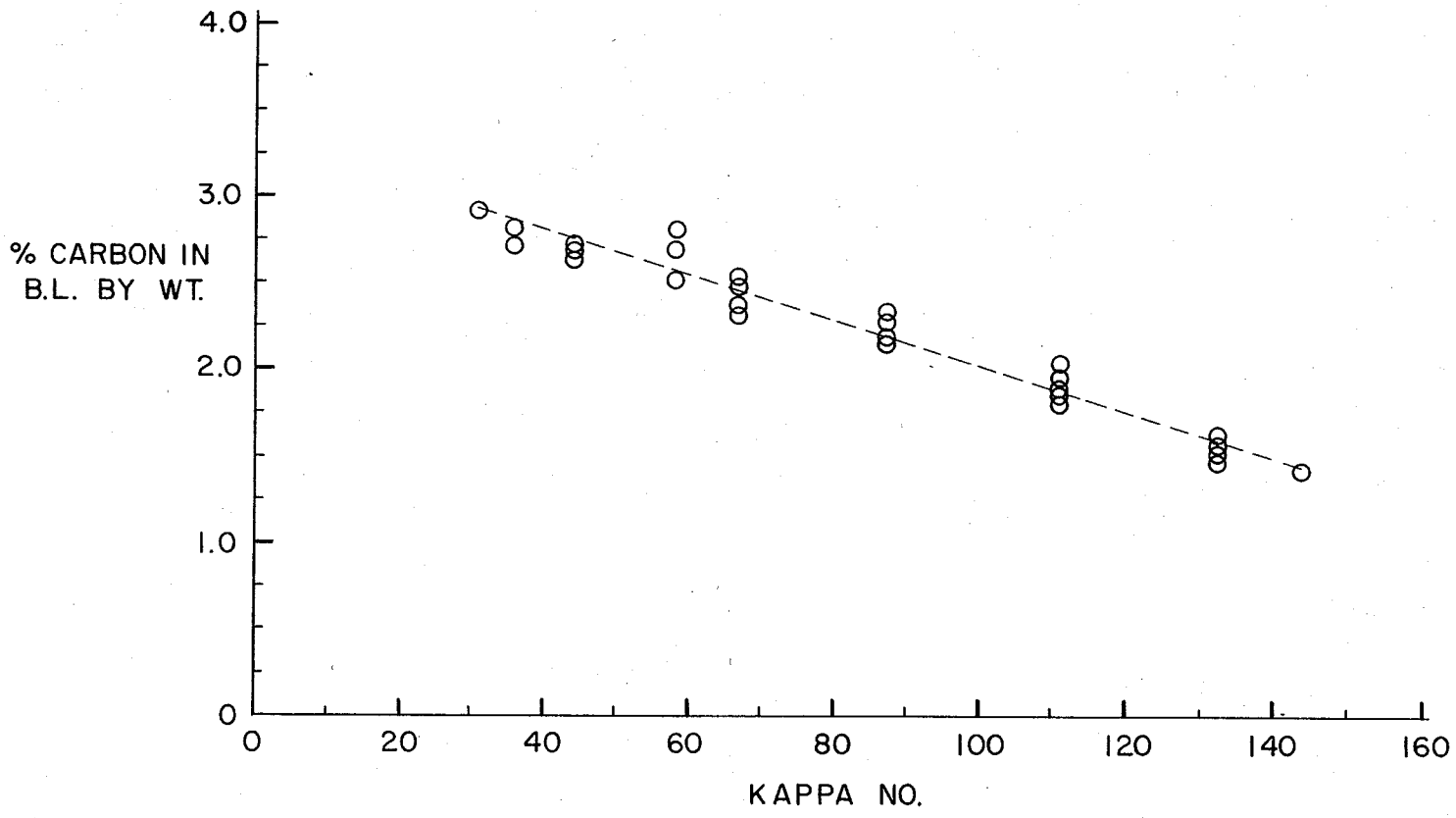
FIG. 5 is a graph of Kappa number versus black liquor total organic carbon showing the inverse linear relationship established by empirical measurement.

The outcomes of the total organic carbon determinations for various experimental examples are illustrated in FIGS. 4 and 5. In each instance the yield and Kappa number of the pulp in digester 12 was also measured. FIG. 4 plots the empirically ascertained linear relationship of total organic carbon content of the black liquor to pulp yield while FIG. 5 plots the empirically ascertained linear relationship of total organic carbon in the black liquor to Kappa number or lignin content in the pulp residue. These results combined in FIG. 3 confirm the previously known linear relationship between Kappa number and pulp yield.

Figure 6:
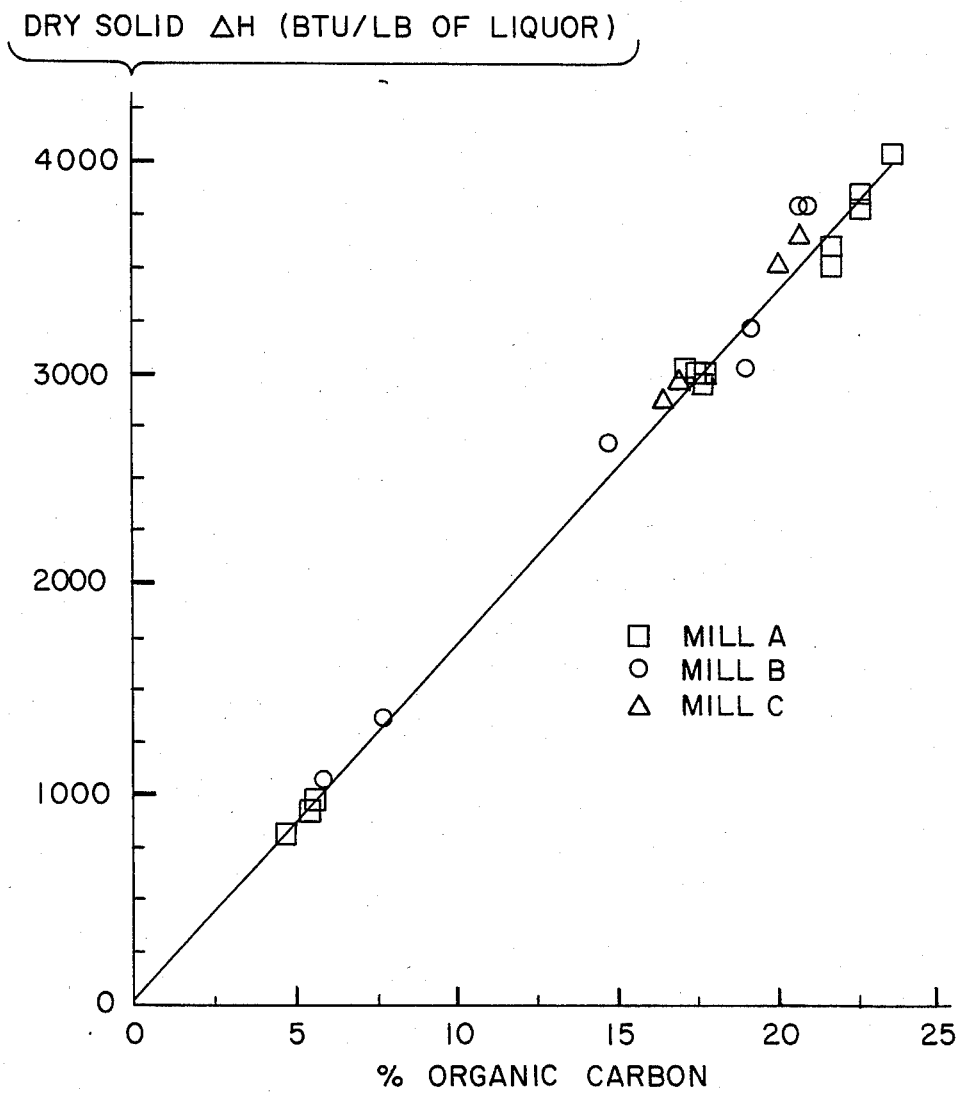
FIG. 6 is a graph of black liquor total organic carbon versus heat content or heat value of the black liquor showing the direct linear relationship passing through the origin established by empirical measurement of black liquor sampled from three paper mills.

The heat content of the black liquor generated by the experimental demonstration of FIG. 2 in BTU's per pound was also ascertained from the literature and plotted against total organic carbon determination using sample black liquor from three different mills. The linear plot of heat content versus total organic carbon content of black liquor passing through the origin is shown in the graph of FIG. 6.

With these results in mind the present invention provides a conservation of carbon mass mathematical model which substantially coincides with the experimental data. The conservation of mass equation of the mathematical model takes the following form where the meaning of each symbol is defined following the equation. This equation compensates for carbon in the original starting liquor referred to as dead load carbon.

$$TOC = \frac{y_{11}[x_1^\circ - Yx_1] + y_{12}[x_2^\circ - Yx_2] + y_{13}[x_3^\circ - Yx_3] + rB}{r + b + [1 - Y]} \quad \text{Equation I}$$

$y_{11}$ = weight fraction of carbon in lignin $y_{12}$ = weight fraction of carbon in carbohydrate (cellulose and hemicellulose)

$y_{13}$ = weight fraction in carbon in extractives $x_1$ = weight fraction of lignin in the pulp or wood residue $x_2$ = weight fraction of carbohydrate in pulp or wood residue $x_3$ = weight fraction of extractives in pulp or wood residue $x_1^o$ = weight fraction of lignin in the starting wood $x_2^o$ = weight fraction of carbohydrate in the starting wood $x_3^o$ = weight fraction of extractives in the starting wood Y = weight fraction of pulp or wood residue to original OD wood at any time T (fractional Yield)

r = liquor to wood ratio

B = weight percent of dead load carbon in the starting liquor b = moisture ratio of wood (gm $H_2O$/gm bone dry wood)

This model disregards a small fraction of carbon which is transformed to $CO_2$ by oxidation reactions during digestion and retained in the alkaline cooking liquor as sodium carbonate. It also disregards trace amounts involved in hydrolysis and the loss of volatile matter through venting.

This model may be further simplified if the extractives $x_3$ and the dead load carbon B are negligible. This simplified Equation II is as follows.

$$TOC = \frac{y_{11}[x_1^\circ - Yx_1] + y_{12}[x_2^\circ - yx_2] + y_{13}x_3^\circ}{r + b + [1 - Y]} \quad \text{Equation II}$$

Figure 7:
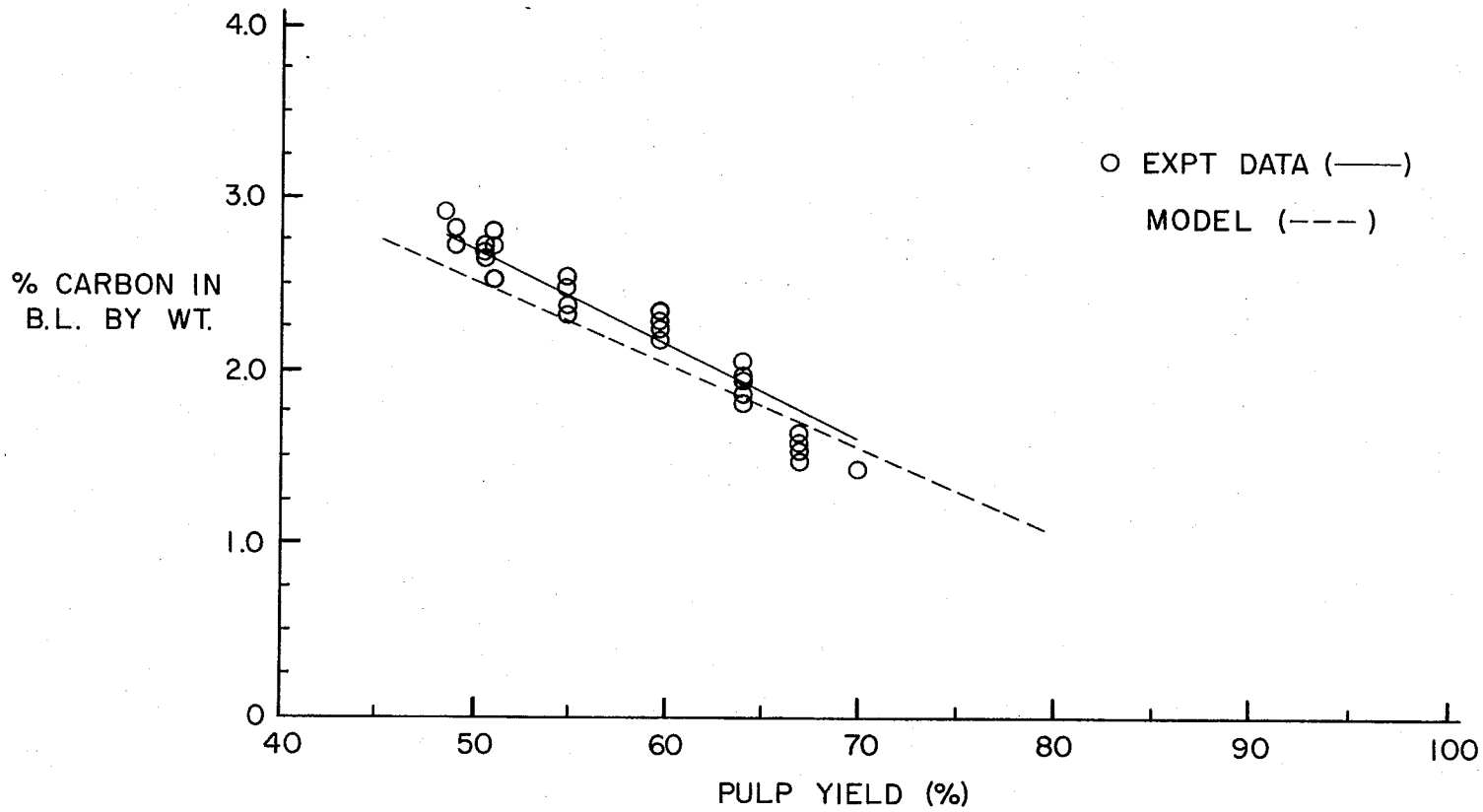
FIG. 7 is a graph of pulp yield versus black liquor TOC comparing experimental data with the closely approximating data predicted by the mathematical model.

Specific data for calculating the TOC may be taken from the Ross diagram for the particular wood species. It is apparent that Equation I may be manipulated into a variety of equivalent formats or may be simplified by making different simplifying assumptions. The graph of FIG. 7 demonstrates that the data generated and predicted by the models substantially coincide within 1 to 2% of the experimentally derived and measured data shown by the solid line. The dotted line represents data values generated and predicted by the model. The fraction yield Y may be related to the Kappa number by the linear equation of the general form:

Equation III $$Y = MX + A$$

as illustrated in the graph of FIG. 3 where M is the slope and A a constant. The percent lignin in the pulp or wood residue remaining is directly related to the Kappa number as 0.147K. Therefore various permutations, substitutions and modifications of the basic Equation I of the mathematical model may be derived relating total organic carbon to either Kappa number or percent lignin content in the pulp in addition to pulp yield.

Actual lignin content of the pulp was verified and determined using TAPPI Standard T-236.

Further details on the procedures establishing utility of the invention and variations of the mathematical model are found in the paper by the inventors herein entitled "Total Organic Carbon (TOC) As An Indicator of Wood Delignification" to be published in the 1983 TAPPI Pulping Conference Proceedings, Alkaline Pulping Session, Oct. 24–26, 1983, Houston, Tex., a copy of which paper accompanies this patent application on filing and is incorporated herein as part of the file history of the patent application. The paper will also be presented to the Annual Meeting of the American Institute of Chemical Engineers (AIChE), Oct. 31, 1983, Washington, D.C.

While the invention has been described with respect to particular example embodiments of batch Kraft processing, the invention is applicable to other types of delignification and pulping reactions and to continuous digesters as would be apparent to persons of ordinary skill. For continuous digesters TOC or TC is monitored in accordance with the method of the invention at several locations along the length of the continuous digester. Different temperature controllers are incorporated along the length to establish the appropriate temperature profile in accordance with mathematical calculations to achieve the desired pulp yield at the end of the digester.

The invention is also applicable to bleaching or secondary delignification by aqueous processes in which the pulp is immersed in bleaching liquor comprising strong oxidizing agents such $O_2$, $O_3$, $H_2Ohd$ 2, $Cl_2$, ClOhd 2, NaOcl, etc., to dissolve further lignin. The use of such caustic liquor extractive stages to solubilize lignin fragments also dissolves carbohydrates and results in a decrease in pulp yield. This yield loss results in an increase in dissolved wood solids and organic carbon in the bleaching liquors. Measuring the yield loss caused by bleaching is also accomplished by applying the total organic carbon monitoring method of the present invention to the bleaching liquor. The invention is intended to cover all such variations and equivalents within the scope of the following claims.

We claim:

1. In a method for monitoring and determining the degree of completion and pulp yield of a pulping or delignification reaction for a known quantity of starting wood or pulp of known carbon content immersed and reacting in a process liquor of known starting carbon content at a known liquor to wood or pulp ratio the improvement comprising:

sampling the liquor during the reaction;

measuring the total organic carbon content of the sampled liquor during the reaction;

calculating the degree of completion of the reaction and pulp yield from the process liquor total organic carbon content measurement using a conservation of carbon mass mathematical model based upon conservation of carbon mass in the wood or pulp and liquor during the reaction, said mathematical model including a conservation of mass equation in which the total organic content in the sampled liquor substantially equals the total carbon content in the starting quantity of wood or pulp less the total carbon content of wood residue at the time of sampling the black liquor, said mathematical mode providing the calculation of the degree of completion and pulp yield based upon the sampled liquor total organic carbon measurement without requiring sampling of the wood or pulp residue of the pulping or delignification reaction;

controlling the reaction in real time according to the calculated degree of completion and pulp yield of the reaction;

and terminating the reaction when the reaction reaches the desired degree of completion and pulp yield calculated by the conservation of carbon mass mathematical model applied to the sampled liquor total organic carbon measurement.

2. The method of claim 1 wherein the step of measuring the total organic carbon content of the sampled liquor comprises measuring and determining the total carbon content of the sampled liquor.

3. The method of claim 2 wherein the step of measuring and measuring the total carbon content comprises combusting the sampled liquor and measuring the quantity of carbon dioxide.

4. The method of claim 3 wherein the step of measuring the quantity of carbon dioxide comprises measuring the quantity of carbon dioxide with an infrared analyzer.

5. The method of claim 3 wherein the step of measuring the total carbon dioxide comprises measuring the quantity of carbon dioxide gravimetrically.

6. The method of claim 2 wherein the step of measuring the total carbon content comprises measuring and determining the quantity of radioactive carbon isotopes present in the liquor sample and inferring the total carbon from the measured fractional radioactive carbon isotopes.

7. The method of claim 1 wherein the step of sampling the liquor during the pulping reaction comprises continuously sampling the liquor.

8. The method of claim 1 wherein the step of determining the total organic carbon content of the sampled liquor comprises determining the total carbon content of the sampled liquor, determining the total inorganic carbon content of the sampled liquor, and subtracting the inorganic carbon content from total carbon content to give the total organic carbon content.

9. The method of claim 8 wherein the step of measuring the total carbon content comprises combusting a first portion of the liquor sample and measuring the total carbon from the carbon dioxide generated by the combustion of the liquor sample; acidifying a second portion of the liquor sample and heating the acidified sample to drive off the inorganic carbon as carbon dioxide and determining the total inorganic carbon by measuring said carbon dioxide; and subtracting the total inorganic carbon from the total carbon to give the total organic carbon content of the liquor.

10. The method of claim 1 wherein the step of controlling the reaction according to the calculated degree of completion and yield comprises controlling the time duration of the reaction.

11. The method of claim 1 wherein the step of controlling the reaction comprises controlling the temperature of the reaction.

12. The method of claim 1 wherein the step of controlling the reaction comprises controlling the ratio by weight of the liquor to wood or pulp.

13. The method of claim 1 further comprising the step of calculating the Kappa number corresponding to the lignin content of the pulp from the total organic carbon content measurement using conservation of carbon mass mathematical model, said model substantially approximating empirically established linear relationship between process liquor total organic carbon content and Kappa number.

14. The method of claim 1 further comprising the step of calculating the heat value of the liquor from the total organic carbon content measurement using a conservation of carbon mass mathematical model substantially approximating the empirically established linear relationship between process liquor total organic carbon content and heat value of the liquor.

15. The method of claim 1 further comprising the step of correcting the H-factor corresponding to the further reaction time to desired degree of completion and pulp yield from the total organic carbon content measurement using said conservation of carbon mass mathematical model.

16. The method of claim 1 wherein the reaction is a primary delignification or pulping reaction and wherein said liquor is a black liquor.

17. The method of claim 1 wherein the reaction is a secondary delignification or bleaching reaction and wherein said liquor is a bleaching liquor.

18. In a method for monitoring and determining the degree of completion and pulp yield of a pulping or delignification reaction for a known quantity of starting wood of identified characteristics immersed and digesting in a known quantity of black liquor at a known black liquor to wood ratio, the improvement comprising:

sampling the starting black liquor and measuring the dead load organic carbon content of the starting black liquor;

determining the total carbon content in the known quantity of starting wood;

sampling the black liquor during the pulping reaction;

measuring the total organic carbon content of the sampled black liquor during the reaction;

calculating the degree of completion of the pulping reaction and pulp yield from the sampled black liquor total organic carbon content measurement using a conservation of carbon mass mathematical model based upon conservation of carbon mass in the wood and black liquor during the reaction, said mathematical model including a conservation of mass equation in which the total organic carbon content in the sampled black liquor less any dead load organic carbon content measured in the starting black liquor substantially equals the total carbon content in the starting quantity of wood less the total carbon content in the of wood residue at the time of sampling the black liquor, said mathematical model providing the calculation of degree of completion and pulp yield based upon the sampled black liquor total organic carbon measurement without requiring sampling of the wood or pulp residue of the pulping or delignification reaction;

controlling the pulping reaction in real time according to the calculated degree of completion and pulp yield of the pulping reaction;

and terminating the pulping reaction when the reaction reaches the desired degree of completion and pulp yield predicted by the mathematical model based upon the sampled black liquor total organic carbon content measurement.

19. The method of claim 18 wherein the step of controlling the pulping reaction in real time comprises controlling the duration, temperature, or black liquor to wood ratio of the pulping reaction.

* * * * *